United States Patent [19]

Nakamura

[11] Patent Number: 5,022,167

[45] Date of Patent: Jun. 11, 1991

[54] PHOTOSENSITIVE MATERIAL DRYING APPARATUS

[75] Inventor: Takashi Nakamura, Minami-ashigara, Japan

[73] Assignee: Fuji Photo Film Co., Ltd., Kanagawa, Japan

[21] Appl. No.: 402,367

[22] Filed: Sep. 5, 1989

[30] Foreign Application Priority Data

Sep. 5, 1988 [JP] Japan ..... 63-221796
Nov. 14, 1988 [JP] Japan ..... 63-287445
Jun. 16, 1989 [JP] Japan ..... 1-153653

[51] Int. Cl.[5] ..... F26B 13/00
[52] U.S. Cl. ..... 34/160; 34/156
[58] Field of Search ..... 34/155, 10, 156, 160

[56] References Cited

U.S. PATENT DOCUMENTS 3,293,775 12/1966 Kitrosser ..... 34/156
4,017,982 4/1977 Goffredo ..... 34/23
4,053,990 10/1977 Bielinski ..... 34/23
4,142,301 3/1979 Goodall ..... 34/155
4,245,397 1/1981 Laar et al. ..... 34/155

*Primary Examiner*—Henry A. Bennet
*Attorney, Agent, or Firm*—Sughrue, Mion, Zinn, Macpeak & Seas

[57] ABSTRACT

An apparatus for drying a photosensitive material in the form of a web is provided wherein a slender box-shaped housing defines an interior space having a rectangular slit-shaped transverse cross section in which its thickness dimension is substantially smaller than its transverse dimension. A fan is connected to the housing through a nozzle for blowing drying air into the interior space to dry the photosensitive web while the web is transferred through the interior space in a longitudinal direction. The difference in relative humidity between upstream and downstream air flows in the interior space at the beginning and the end of drying is controlled to at least 30% RH.

20 Claims, 7 Drawing Sheets

PHOTOSENSITIVE MATERIAL DRYING APPARATUS

FIELD OF THE INVENTION

This invention relates to an apparatus for drying wet-processed photosensitive material.

BACKGROUND OF THE INVENTION

A variety of apparatus for wet processing photo. sensitive material are known, for example, silver salt photographic copying machines and automatic developing machines.

The silver salt photographic copying machine is designed to reproduce a copy from an original image by supplying a photosensitive material typically in the form of a color paper web from a paper source to an exposure zone where the web is exposed, transferring the exposed web to a processing zone where it is successively subjected to development, bleach-fixation and rinsing, and finally drying the web in a drying zone. The automatic developing machine is designed to produce a negative or positive image by successively subjecting an exposed photosensitive material typically in the form of a color negative film to development, bleaching, fixation, rinsing, and stabilization in a processing zone and finally drying the film in a drying zone. The drying apparatus used in each drying zone of these photosensitive material processing apparatus includes a duct surrounding a path for carrying the photosensitive material and a heater and fan for blowing warm air into the duct whereby while the photosensitive material is being conveyed through the duct in a wet state, warm air is blown onto the photosensitive material for drying.

These prior art drying apparatus have a drawback that although a large volume of warm air is supplied because of the large volume of the duct interior space, only a small proportion of warm air actually contacts the surface of the photosensitive material and thus contributes to water removal. Because of such inefficient utilization of warm air, it takes a long time to fully dry the photosensitive material. A long drying time is one of bars against the demand for shortening the total processing time particularly in wet type copying machines and automatic developing machines.

Besides, heating a large volume of air requires a large quantity of energy consumption. In addition, a correspondingly large quantity of waste heat is exhausted to the exterior, imposing undesirable effects like temperature and humidity increases to the environment where the machine is installed. Also undesirably, it takes some time to heat up at the start of operation.

The increased heat-up time makes it unfeasible to turn on and off the drying apparatus every time when it is desired to process photosensitive material. The drying apparatus should be continuously turned on irrespective of whether or not the photosensitive material is processed, also inviting an increase of energy consumption.

The prior art drying apparatus has a serious influence on the emulsion layer of photosensitive material. The prior art drying apparatus is designed such that once warm air is supplied into the duct and utilized for drying, about 70 to 95% of the warm air is recovered for recycle to the duct. When a large quantity of photosensitive material is continuously processed, the material is dried with incrementally humid warm air from some time on, causing defects such as reticulation and crazing on the emulsion surface of photosensitive material.

Japanese Utility Model Application Kokai No. 44331/1973 discloses a drying apparatus for photographic processing, which belongs to the same technical field as the present invention. This reference shows an apparatus for drying photosensitive material with hot air between feed rollers and take-out rollers. Drying air is heated hot and passed over the surface of photosensitive material in the interior of the apparatus for drying the material. The drying apparatus includes discharge means for discharging the drying air which has completed drying and thus picked up some moisture through a portion of the drying apparatus.

The objects of the known drying apparatus for photographic processing are to accomplish drying in a short time and to pneumatically convey the photosensitive material with the air flow through the transfer path (which corresponds to the slit-shaped interior space of the present invention as will be disclosed later), but pays no attention to the control of the humidity difference between the beginning and the end of drying. For this reason, the entire longitudinal distance of the transfer path of the drying apparatus is short, that is, only about 2 to 3 times the total length of the blowing openings of the nozzle. The Kokai reference does not indicate a need for dehumidifying means because the used drying air is discharged out of the apparatus. The known drying apparatus for photographic processing cannot achieve a difference of at least 30% RH in relative humidity between areas in the transfer path near the beginning and the end of drying, thus failing to avoid defects like reticulation on the photosensitive material emulsion surface.

SUMMARY OF THE INVENTION

Therefore, an object of the present invention is to eliminate the above-mentioned drawbacks of the prior art and to provide a novel and improved apparatus for drying photo sensitive material which is efficient in drying, especially short in drying time, which minimizes the energy consumption, and which can be of compact size.

Another object of the invention is to provide an apparatus for drying photosensitive material which avoids the occurrence of defects such as reticulation on the emulsion surface of photosensitive material.

According to the present invention, there is provided an apparatus for drying a photosensitive material in the form of a web, comprising a housing defining an interior space having longitudinal, transverse and height dimensions, said interior space having a slit-shaped transverse cross section in which the height dimension is substantially smaller than the transverse dimension, and fan means connected to the housing for blowing drying gas into the interior space to dry the photosensitive web while the photosensitive web being transferred through the interior space in a longitudinal direction, wherein the difference in relative humidity between the drying gases in the interior space at the beginning and the end of drying is at least 30% RH.

The term web is used to cover a length of photo. sensitive material having longitudinal and transverse dimensions with a relatively reduced thickness dimension. Thus the webs include conventional photographic films (roll films), photosensitive material strips such as photographic color paper in roll form, and separate sheets of photo. sensitive material. The type of photosensitive material will be described later.

According to the present invention, the interior space of the housing through which the photosensitive material travels in the longitudinal direction has a slit-shaped transverse cross section in which the height dimension is substantially smaller than the transverse dimension. Consequently, the volume of the housing interior space is so markedly reduced that a small volume of drying gas can be passed at a high velocity, allowing the photosensitive material to be dried within a short time over a relatively short transfer path. There are available additional advantages of energy savings and controlled influence on the room environment where the drying apparatus is installed, as well as size reduction.

The controlled difference of at least 30% RH in relative humidity between the drying gases in the interior space of the housing at the beginning and the end of drying is effective in avoiding defects in a surface coating, for example, reticulation on the emulsion surface, of photosensitive material.

When it is desired to dry with warm air, the drying air can be instantaneously heated up because only a small amount of drying air is necessary. Thus the drying apparatus can be controlled such that it is turned on to start blowing immediately before the start of drying operation and turned off to interrupt blowing after the completion of drying. Then air blowing takes place for only the drying duration, leading to further savings of energy and minimized influence on the room environment where the drying apparatus is installed.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

Figure 1:
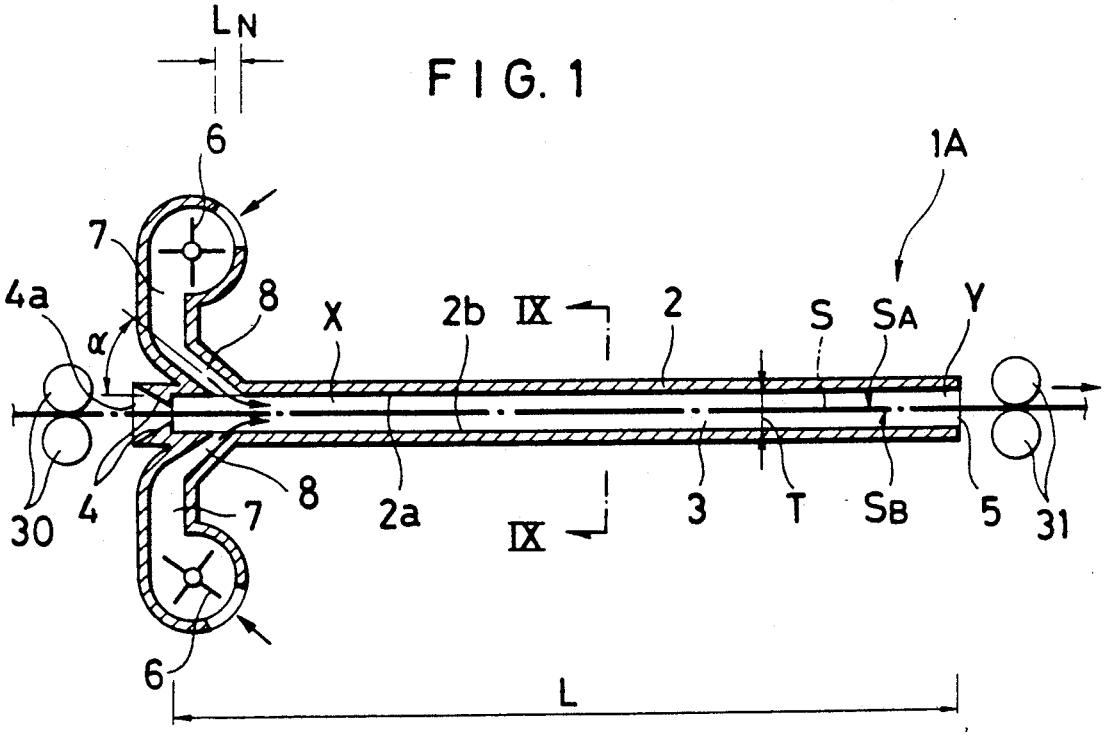
FIGS. 1 through 8 schematically show drying apparatus according to first to eighth different embodiments of the present invention.

FIGS. 1 through 8 schematically show drying apparatus according to different embodiments of the present invention. Like parts are designated by the same reference numerals throughout the figures and their description is made only for the first appearance and omitted from the description of later embodiments to avoid redundancy.

Figure 9:
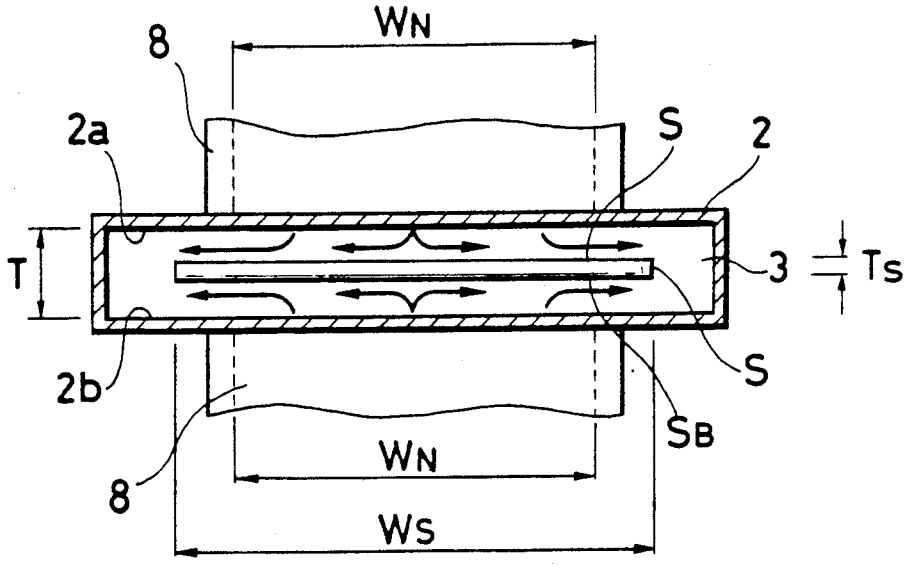
FIG. 9 is a cross section of the housing taken along lines IX—IX in FIG. 1.

Referring to FIGS. 1 and 9, there is illustrated a drying apparatus 1A according to a first embodiment of the invention. The drying apparatus 1A includes a housing 2 of generally rectangular box shape having a rectangular transverse cross section. The housing 2 has at the left end an entrance 4 through which photosensitive material in the form of a web S enters the housing space and at the right end an exit 5 through which web S exits the housing space. In the disclosure, the entrance 4 side is referred to "forward" or "upstream" side and the exit 5 side is referred to "rearward" or "downstream" side for the sake of convenience.

The housing 2 defines an interior space 3 having longitudinal, transverse and height dimensions. The interior space 3 extends from the entrance 4 to the exit 5 in the longitudinal direction and has a slit-shaped transverse cross section in which the height dimension T (see FIG. 9) is substantially smaller than the transverse dimension. The photosensitive web S travels through the interior space 3 in the longitudinal direction from entrance 4 to exit 5. Thus the thickness direction of photosensitive web S is parallel to the height dimension of the slit-shaped cross section of the interior space 3. The dimensions of the interior space are described later in detail. In the illustrated embodiment, the interior space 3 has a flat structure as viewed in FIGS. 1 and 9, but may have a corrugated or curved structure as long as it does not disturb the passage of photosensitive web S.

The housing 2 near its entrance 4 is provided with a pair of upper and lower nozzles 8 in communication with the interior space 3. The upper and lower nozzles 8 are connected to the upper and lower walls of the housing 2 adjacent the entrance 4, respectively. Since the photosensitive web S which travels through the interior space 3 divides the interior space 3 into an upper space or path on the side of an upper or emulsion surface $S_A$ and a lower space or path on the side of a lower or back surface $S_B$ of photosensitive web S, the upper and lower nozzles 8 communicate with the upper and lower flowpaths on the emulsion and back surfaces $S_A$ and $S_B$ of photosensitive web S, respectively.

The nozzles 8 have slit-shaped openings at the distal ends and are connected at the proximal ends to discharge outlets 7 of fans or blowers 6. The nozzles 8 are mounted to the housing such that they are rearwardly inclined with respect to the longitudinal axis of housing 2 whereby the air propelled by fans 6 through discharge outlets 7 is smoothly blown into interior space 3 through nozzles 8 to form high velocity air streams flowing rearwardly through interior space 3. The air which has passed interior space 3 is discharged through the exit 5. Although the drying gas fed by fans 6 to interior space 3 includes air and other inert gases, air is referred to as a typical example throughout the disclosure for brevity of description.

The apparatus further includes a pair of conveyor rollers 30 upstream of entrance 4 and a pair of conveyor rollers 31 downstream of exit 5. The rollers are driven by suitable drive means (not shown) to convey a photosensitive web rearward while clamping it therebetween.

With the above-described construction, a photosensitive web S in wet state is carried to housing entrance 4 by means of conveyor rollers 30 and transferred through interior space 3 while air is passed through interior space 3 from the forward end to the rearward end at a high velocity. Water is removed from the upper and back surfaces $S_A$ and $S_B$ of photosensitive web S during its travel through the interior space, completing drying of photosensitive web S. The humidity of the atmosphere in the interior space 3 gradually increases from the forward end to the rearward end. According to the present invention, the difference (magnitude) in relative humidity between the end of drying Y near the rear end of housing 2 and the beginning of drying X near the joint between nozzles 8 and housing 2 is at least 30% RH, preferably in the range of about 50% to about 90% RH. The controlled relative humidity difference avoids any defects, especially reticulation on the upper or emulsion surface $S_A$ of photosensitive web S.

Figure 2:
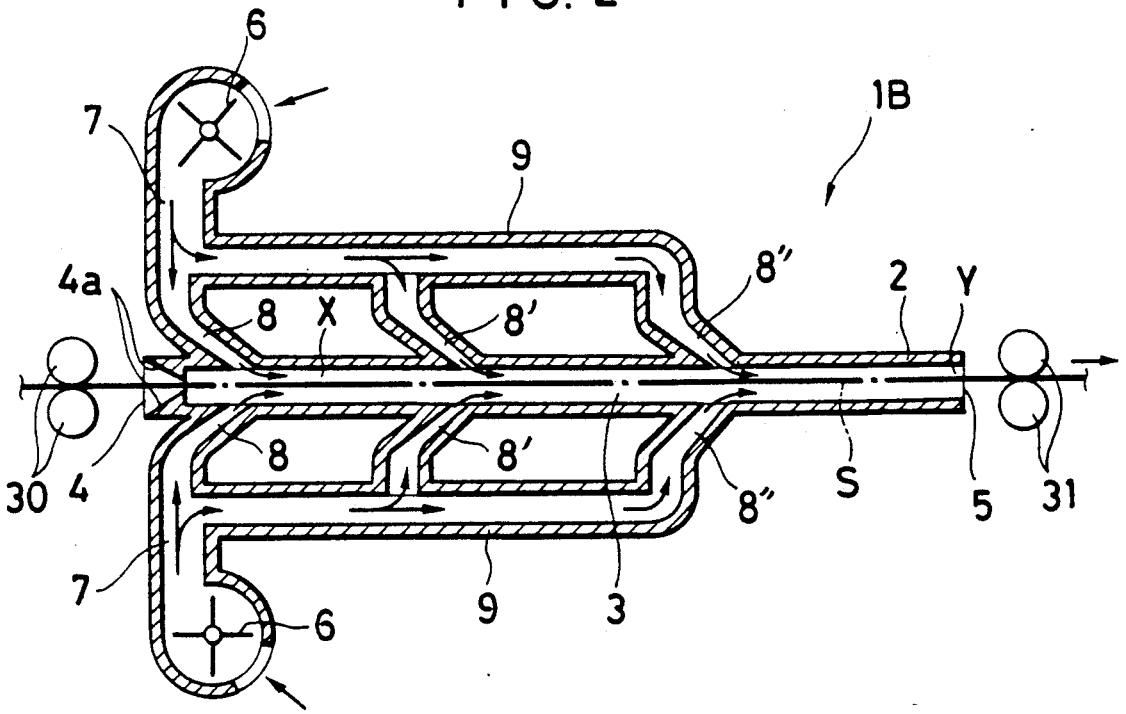
Figure 7:
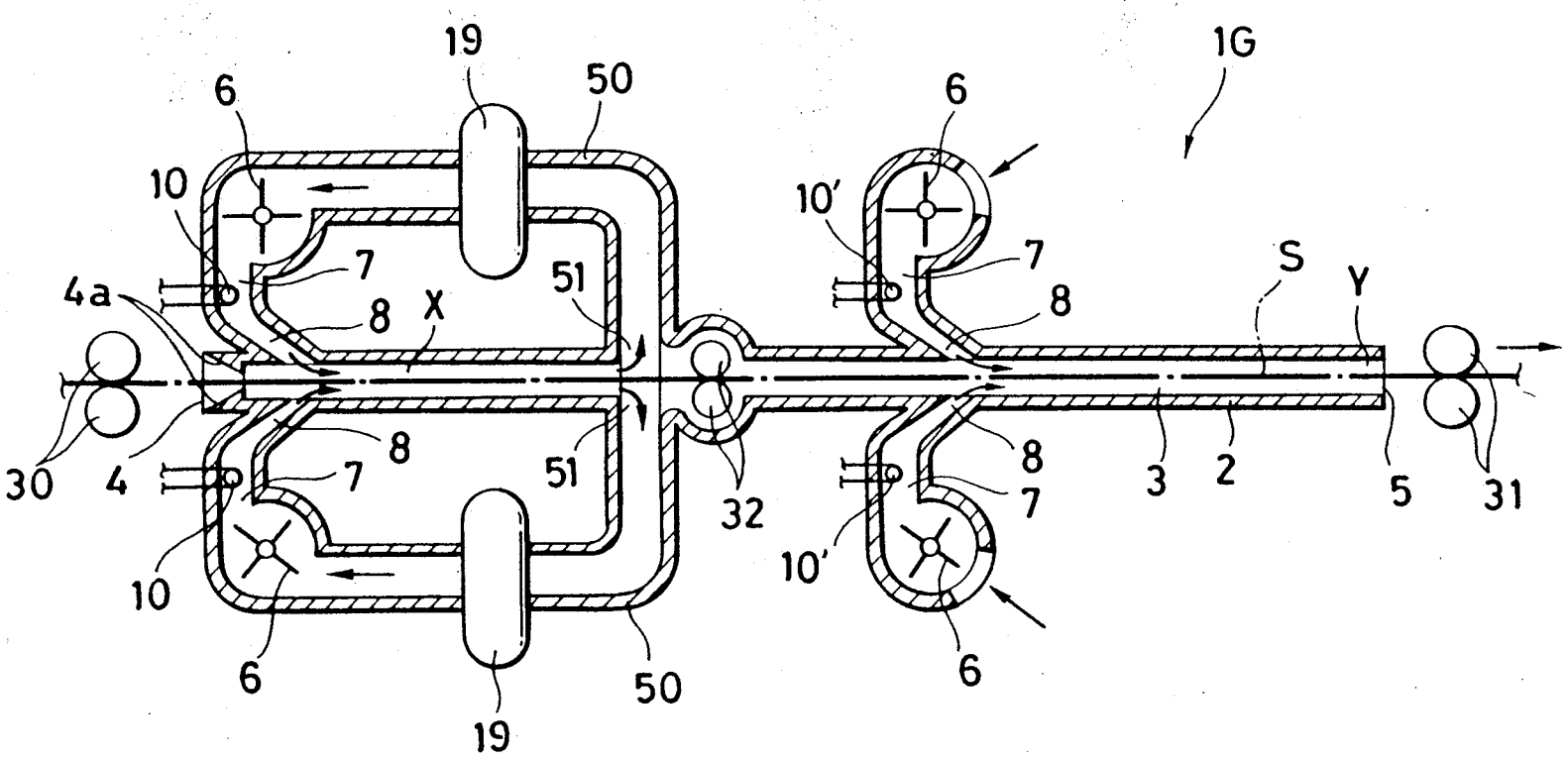

In the nozzle arrangement illustrated in FIG. 1 wherein a pair of nozzles 8 are arranged on housing 2 adjacent its entrance 4, the beginning of drying X is positioned near the air blowing openings of nozzles 8 and the end of drying Y is positioned near exit 5 of housing 2. The same applies to the embodiments of FIGS. 3 to 5 and 8. In other nozzle arrangements as shown in FIGS. 2 and 7 wherein plural pairs of nozzles are arranged on housing 2 at intervals in the longitudinal direction, the beginning of drying X is positioned near the air blowing openings of the most forward nozzles.

The entrance 4 of housing 2 is provided with ramps 4a which are rearwardly slanted from the outside to the inside of upper and lower housing walls for assisting in photo sensitive web S entering interior space 3. The ramps 4a at the rear ends are provided with weirs or steps for preventing the reverse flow of the air injected from nozzles 8, that is, preventing the air injected from nozzles 8 from flowing forwards to escape through entrance 4.

It will be noted that the nozzles 8 are at an inclination angle $\alpha$ with respect to the longitudinal axis of housing 2 in the illustrated embodiment. The inclination angle $\alpha$ is preferably in the range of from about 5° to about 60°. A nozzle inclination angle of less than 5° is undesirable for compact design whereas an inclination angle of more than 60° tends to allow reverse flow to entrance 4.

In the illustrated embodiment, air is supplied to both the upper and back surfaces of photosensitive web S travelling through interior space 3, forming air streams between housing upper wall 2a and upper surface $S_A$ of web S and between housing lower wall 2b and back surface $S_B$ of web S, which prevent web S from closely contacting to housing upper and lower walls 2a and 2b. Since it is desired to prevent the contact of web S to the housing walls, the nozzles 8 attached to the housing upper and lower walls should preferably be symmetric in shape and inclination angle $\alpha$ and equal in air blowing capacity in order to maintain the upper and lower air streams in equilibrium.

As seen from FIG. 9 which is a cross section along lines IX—IX in FIG. 1, preferably the upper and lower nozzles 8 have at the blowing openings a transverse width Wn which is smaller than the transverse width Ws of photosensitive web S (that is, $Wn < Ws$). The air streams injected from upper and lower nozzles 8 first impinge on the upper and back surfaces $S_A$ and $S_B$ of web S, and are then diverted to the transverse opposite sides of web S as shown by thick solid arrows while advancing to the downstream. The air streams on the upper and back surfaces of web S are maintained in equilibrium, controlling the vertical and transverse vibration of web S for stabilization.

The housing 2 may be provided with means for preventing web contact (not shown), for example, flexible members inwardly protruding from the housing inner walls (e.g, fiber loops) as disclosed in Japanese Patent Application No. 277678/1987. Also the housing 2 may be provided with means for preventing web vibration (not shown), for example, rails, channels or any other guide members longitudinally extending on the housing inner walls.

The photosensitive web S is transferred through the housing 2 as follows. If the longitudinal distance of photosensitive web S is longer than the longitudinal distance of housing 2, more exactly the distance between conveyor rollers 30 at entrance 4 and conveyor rollers 31 at exit 5, the driving forces of conveyor rollers 30 and 31 play the role of transferring web S through housing 2. More particularly, the web S is moved rearward through interior space 3 by the clamp/drive force of at least one pair of conveyor rollers 30 and 31 since the leading edge of web S reaches conveyor rollers 31 at exit 5 and is clamped therebetween before the trailing edge of web S leaves the conveyor rollers 30 at entrance 4.

If the longitudinal distance of photosensitive web S is shorter than the longitudinal distance of housing 2, the web S is moved rearward by the clamp/drive force of conveyor rollers 30 at entrance 4 until the web leaves rollers 30. Thereafter, the web S is conveyed rearward by the high velocity air streams (sometimes referred to as pneumatic transfer) until the web reaches conveyor rollers 31 at exit 5 where the web is again clamped and transferred by conveyor rollers 31. Even in this case, there may be provided any additional conveyor means for moving rearward the web through interior space 3, for example, roller or belt conveyor systems such as pairs of conveyor rollers or an endless belt.

The dimensions of interior space 3 of housing 2 are now described. In general, the housing interior space 3 has a transverse width W of about 30 mm to about 200 mm and a height T of about 1 mm to about 40 mm. The transverse width W should be larger than the transverse width Ws (the expected maximum width) of photosensitive web S. The height T of interior space 3 is preferably about 3 to 1,000 times, more preferably about 5 to 100 times the thickness of photo sensitive web Ts. With an interior space height of less than 3 times the thickness of photosensitive web S, there will often arise troubles like blockage due to adhesion of the web to the housing inner wall or flaws or scratches on the web. With an interior space height of more than 1,000 times the thickness of photosensitive web S, the interior space 3 has an increased volume with which the invention sometimes becomes less effective for a particular drying requirement.

It is also contemplated that the housing 2 is tapered, that is, the height T of interior space 3 gradually increases toward the entrance or exit. Tapering can impart a variation to the flow velocity of air streams through interior space 3 in the longitudinal direction. For example, if the flow velocity of air is high in an early stage of drying or the height T gradually increases toward the rear end, a later stage of drying becomes slow drying, which is particularly effective in preventing the occurrence of defects in those photosensitive materials containing less hardener or having a thicker emulsion layer. Conversely, if the height T gradually decreases toward the rear end, the later stage of drying still achieves relatively quick drying, which is particularly effective for those photo. sensitive materials having a thinner emulsion layer because of a short drying pass or time.

FIG. 2 illustrates a drying apparatus 1B according to a second embodiment of the invention. The drying apparatus 1B includes plural pairs of longitudinally spaced nozzles connected to housing 2. More particularly, three pairs of nozzles 8, 8', and 8'' are arranged on the upper and lower walls of housing 2 from the forward end to an intermediate toward the rearward end. The fans 6 are communicated to upstream nozzles 8 through through discharge outlets 7 and to intermediate and downstream nozzles 8' and 8'' through branch ducts 9 connected to discharge outlets 7. These nozzles 8, 8', and 8" are the same as described and illustrated in the first embodiment in conjunction with FIGS. 1 and 9.

For the same reason as described in the first embodiment, the nozzles which are mounted on the opposite sides of housing 2 with respect its longitudinal axis (in register with the photosensitive web S to be transferred therethrough) are preferably symmetric in shape, inclination angle, and arrangement and equal in air blowing capacity.

Provision of plural pairs of nozzles has an advantage that even if the air streams injected from upstream nozzles 8 lose their velocity by pressure drops, intermediate and downstream nozzles 8' and 8" can supply additional air streams to compensate for such inconvenience if any. Therefore, the illustrated embodiment is advantageous particularly when the housing is relatively long in the longitudinal direction, when the photosensitive web is pneumatically transferred, or when a higher drying efficiency is desired.

In drying apparatus 1B, the housing 2 is sufficiently long relative to the total of longitudinal distances ($L_N$) of air blowing openings of nozzles 8, 8' and 8", preferably at least 30 times, especially 50 to 5,000 times, most preferably 100 to 1,000 times the latter. The length of housing 2 is convenient to establish the specific humidity difference between the beginning of drying X and the end of drying Y. Usually the housing 2 has a length L of about 100 mm to about 1,000 mm and the ratio ($W/W_N$) of housing width to nozzle width ranges from about 1 to 1.3.

Figure 3:
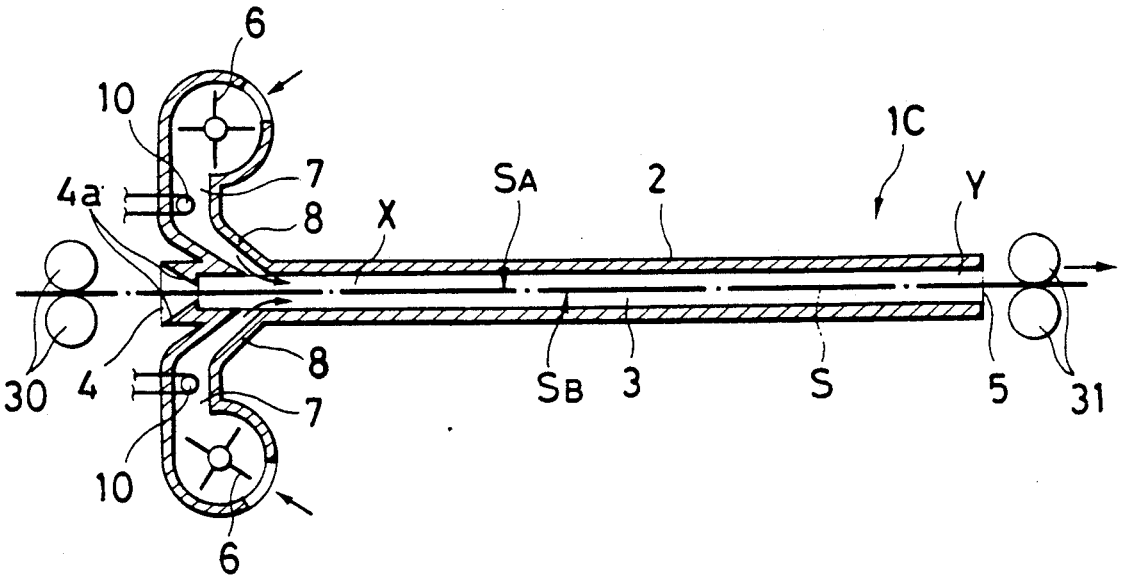
Figure 4:
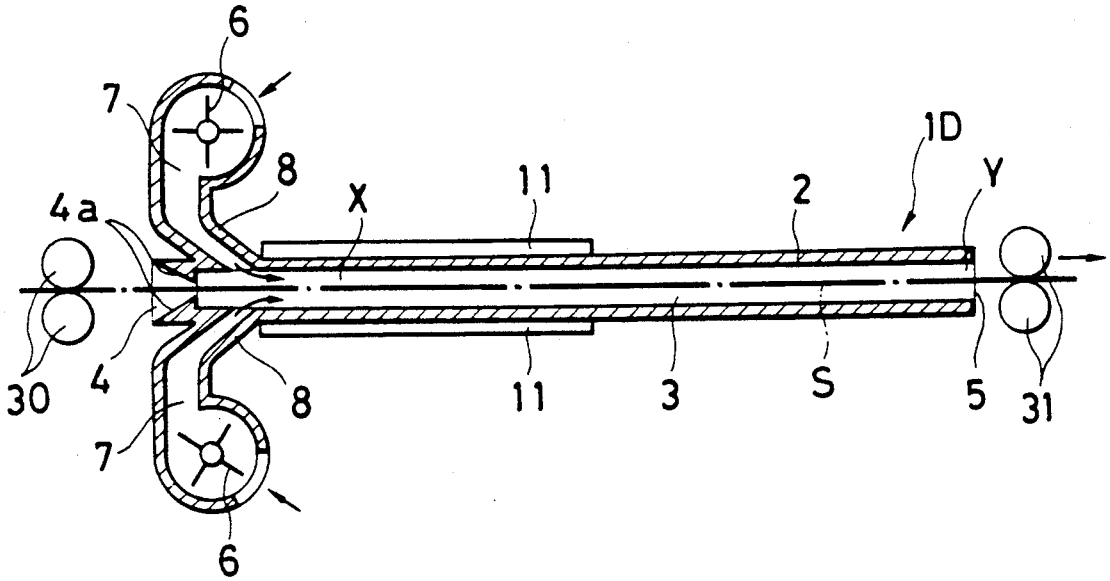

FIGS. 3 and 4 illustrate drying apparatus 1C and 1D according to third and forth embodiments which include heater means for heating drying air so that the photo. sensitive web S is dried with warm air. These apparatus 1C and 1D are more effective in drying than the foregoing apparatus 1A and 1B.

The drying apparatus 1C of FIG. 3 includes heaters 10 disposed in discharge outlets 7 of fans 6 whereby warm air heated by heaters 10 are blown into housing interior space 3 through nozzles 8.

The temperature of warm air introduced into interior space 3 is not particularly limited and may generally range from about 40° C. to about 150° C. Preferably, at least the air stream supplied to the upper surface $S_A$ of photo sensitive web S is heated to a temperature of about 70° C. or higher.

It is preferred that the difference (Tmax−Tmin) between the maximum temperature Tmax and the minimum temperature Tmin in interior space 3 is in the range of about 20° C. to about 100° C. Such a temperature difference, especially of more than 40° C. is effective in preventing defects like reticulation on the emulsion surface.

The drying apparatus 1D of FIG. 4 includes panel or film heaters 11 attached to the upper and lower walls of housing 2. The film heaters 11 heat the walls of housing 2 which radiate heat to the air streams injected from nozzles 8 and flowing through interior space 3. The temperature of the thus heated air streams may be the same as described for the third embodiment.

In the drying apparatus 1C and 1D with heaters, the drying temperatures on the side of upper and back surfaces $S_A$ and $S_B$ of photosensitive web S, that is, the temperatures of the upper and lower streams of drying air may be the same although the temperature of the upper air stream is preferably higher than that of the lower air stream. For example, the temperature of the upper air stream is in the range of from 70° C. to 150° C. while the temperature of the lower air stream is in the range of from 40° C. to lower than 70° C. The reasons why the drying air streams on upper and back surfaces $S_A$ and $S_B$ of photosensitive web S are set at different temperatures are that the upper surface $S_A$ of photosensitive web S having the emulsion layer should be preferentially dried and that the temperature difference prevents curling of photosensitive web S, thereby improving the conveyance of web S through housing 2.

It will be understood that the optimum range of drying temperature and the differential drying temperature between upper and lower air streams are equally applicable to other embodiments which will be described later.

Figure 5:
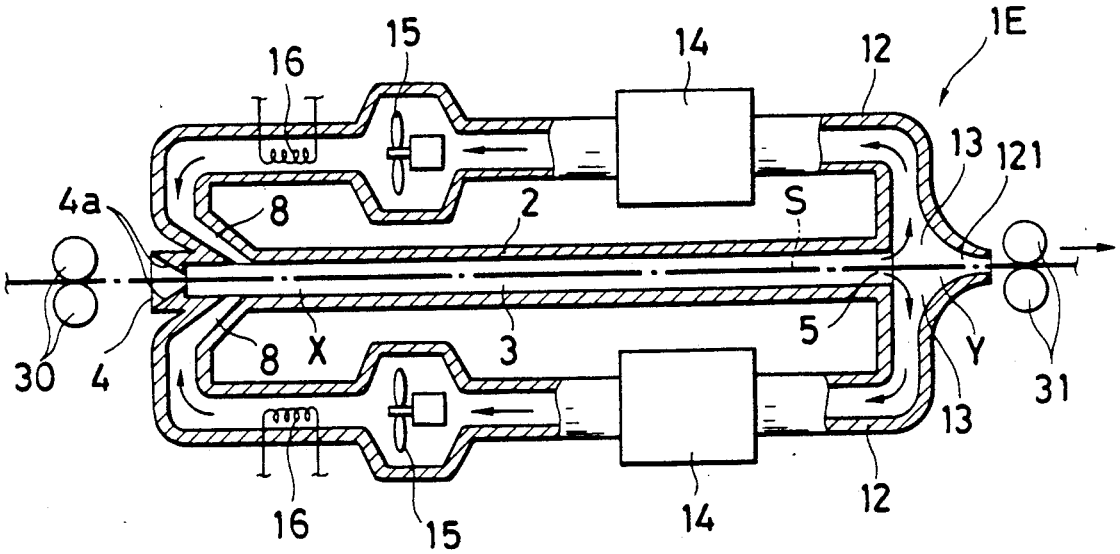
Figure 6:
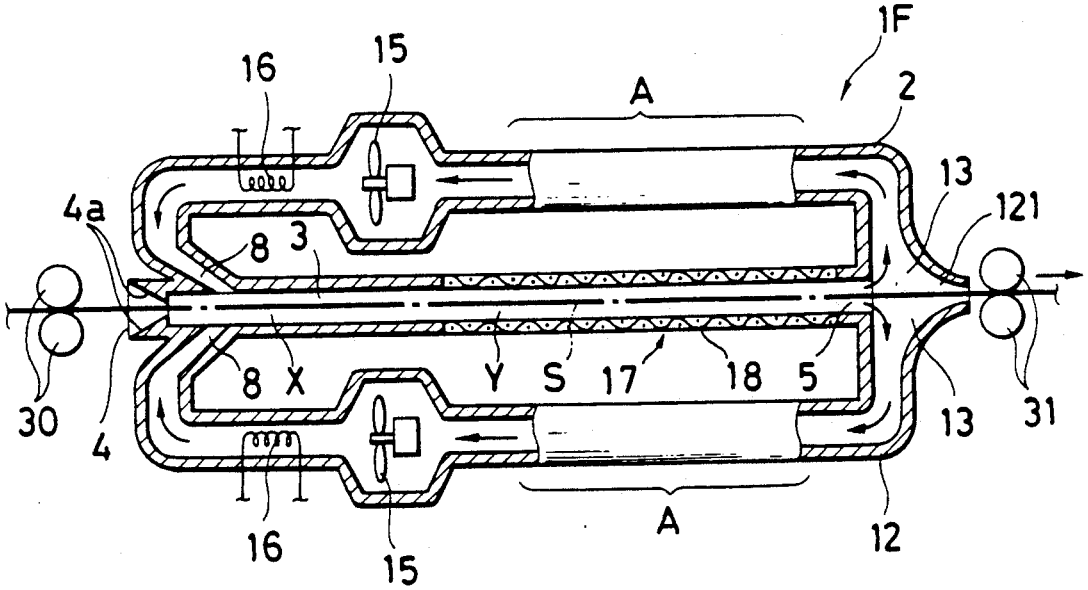

FIGS. 5 and 6 illustrate drying apparatus 1E and 1F according to fifth and sixth embodiments. These drying apparatus 1E and 1F include dehumidifier means for removing water from used drying air as well as heater means for heating drying air whereby the used air can be recycled. In such a recycle system, the desired humidity difference between the beginning of drying X and the end of drying Y can be readily accomplished by providing dehumidifier means.

The drying apparatus 1E of FIG. 5 includes two air circulating means of symmetric structure outside the upper and lower walls of housing 2. Each air circulating means includes a duct 12 having an inlet or rearward end 13 connected to housing 2 at exit 5 for taking in the used air. The housing 2 and ducts 12 are integrated at exit 5 to form a slit-shaped opening 121 through which photosensitive web S exits to the conveyor rollers 31. The slit-shaped opening 121 is convergent in the downstream direction so that photo sensitive web S may easily pass therethrough while only a minimal amount of air escapes therethrough.

The air circulating means further includes a dehumidifier 14 fitted intermediate duct 12, a propeller fan 15 disposed in a dilated portion of duct 12, and a heater 16 disposed in a forward portion of duct 12. The outlet or forward end of duct 12 is connected to nozzle 8.

The dehumidifier 14 may be of any well-known structures including one using ordinary coolant as used in air conditioners, an electronic cooling element utilizing Peltier effect, and a simple tube structure filled with desiccants such as calcium chloride and silica gel. Among them, the dehumidifier using an electronic cooling element is described below as a typical example. Reference should also be made to Japanese Patent Application No. 221796/1988.

Figure 10:
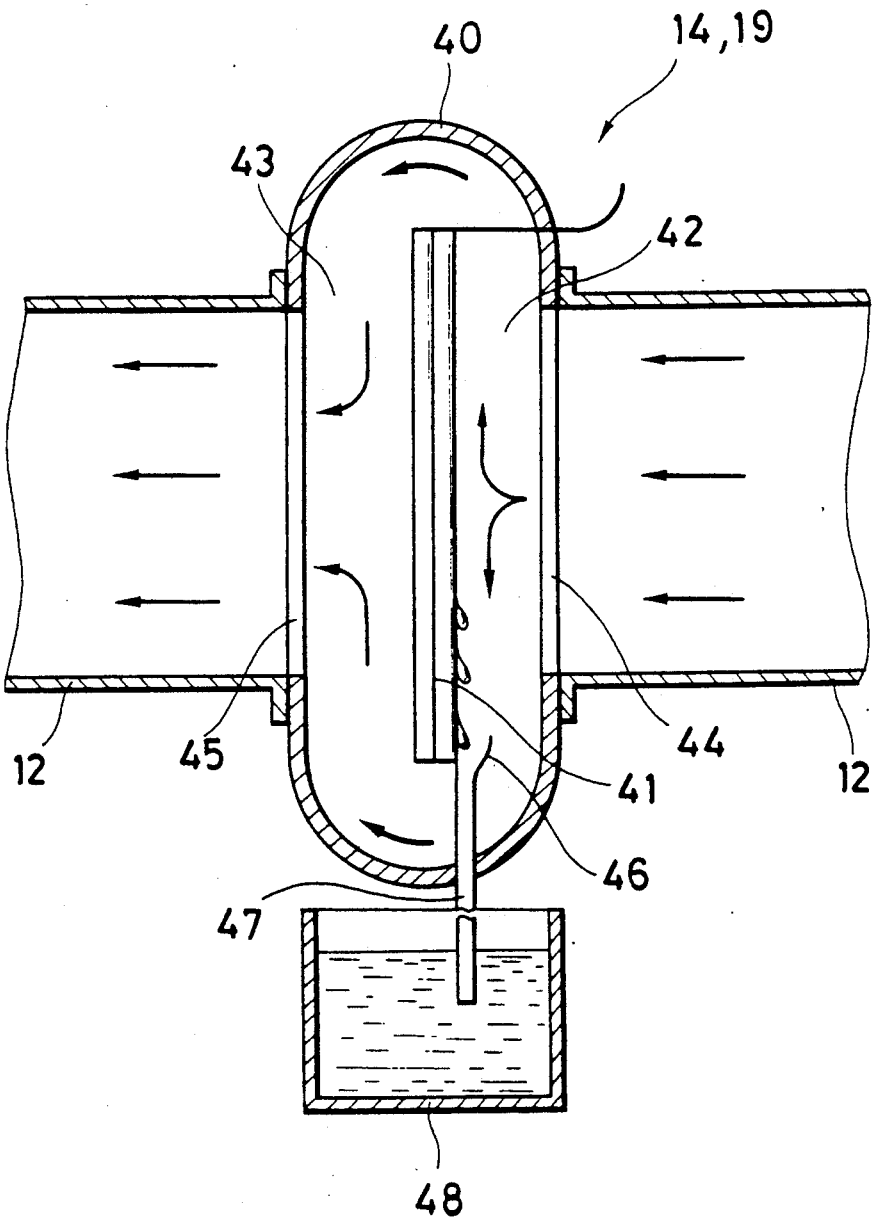
FIG. 10 is a partially cut-away elevation of a dehumidifier using an electronic cooling element which may be mounted in the apparatus of FIGS. 5, 7 and 8.

Referring to FIG. 10, the humidifier 14 includes a hollow casing 40 connected at inlet and outlet openings 44 and 45 between sections of duct 12 and an electronic cooling element or Peltier element 41 disposed in casing 40. The electronic cooling element 41 utilizes Peltier effect and has a heat absorbing segment 42 and a heat releasing segment 43 mated together on the right and left sides in FIG. 10. The inlet and outlet openings 44 and 45 face the heat absorbing and releasing segments 42 and 43, respectively. Below the heat absorbing segment 42 of Peltier element 41 is disposed a receptacle 46 connected to a drain pipe 47 which extends downward through the casing 40 to a sump 48. Water droplets created on the heat absorbing segment 42 as a result of dew condensation are collected by receptacle 46, drained outside casing 40 through pipe 47, and collected in sump 48. It will be understood that the sump 48 may be installed one for each of the dehumidifiers or common to all the humidifiers.

In the dehumidifier 14 of the above-illustrated construction, as shown by arrows in FIG. 10, humid air enters casing 40 through inlet opening 44 under the impetus of fan 15 and impinges against heat absorbing segment 42 of Peltier element 40 whereby the air is diverted to upward and downward streams as shown by forked arrows. The air is cooled during passage along heat absorbing segment 42 of element 40, and dew condensates on the surface of element 40. Water droplets created by dew condensation flow downward under gravity, and collect in sump 48 through receptacle 46 and drain pipe 48.

The air streams which have been cooled and dehumidified in the heat absorbing zone (42) pass over element 40 at its upper and lower edges and join together in a heat releasing zone (43) where air is heated again. The reheated air is fed from the heat releasing zone (43) to the downstream section of duct 12 through outlet opening 45. At this point, the air has a humidity of 5 to 20% RH, for example.

The above-illustrated dehumidifier utilizing an electronic cooling element has advantages of compact size, high dehumidifying capacity, and low power consumption.

In the drying apparatus 1E, air is circulated as follows. Upon actuation of fans 15, negative pressures are created in duct inlets 13 whereby the air which has been used for drying and is thus more humid is sucked into the inlets 13 from the exit 5 of housing 2 and reaches dehumidifiers 14 through ducts 12. The air is dehumidified in dehumidifiers 14, propelled forward by fans 15, heated by heaters 16, preferably to a temperature of about 70 to 150° C., and then blown into interior space 3 of housing 2 through nozzles 8 to form high velocity air streams again.

Compared with the drying apparatus 1E of FIG. 5, the drying apparatus 1F of FIG. 6 is different in the construction of dehumidifying means. Rearward portions or later drying portions of the upper and lower walls of housing 2 (facing the upper and lower surfaces of photosensitive web S) are provided with openings 17 which are filled with water vapor permeable membranes 18 as the dehumidifying means. The membranes have water vapor permeability or selective permeability. Examples of the water vapor permeable membranes 18 include fine mesh reticulated structures, woven fabric, and non-woven fabric of metal wires or heat resistant fibers (e.g., glass and carbon fibers), asbestos, porous members of heat resistant resins, ceramic plates, foamed ceramics and other heat resistant porous materials. If the air inflow to the housing rearward portion is at relatively low temperatures (especially lower than 60° C.), the water vapor permeable membranes 18 need not be heat resistant and may be selected from a wider range including water vapor selectively permeable fabrics (trade name, Gore Tex), porous plastics (e.g., Porex by Gloss Rock Company, material: ultra-high molecular weight polyethylene, polypropylene, polyvinylidene fluoride, etc.), and microporous films (e.g., Cellpore by Sekisui Chemical K.K., material: polyolefinic plastics) in addition to the above-mentioned examples.

In the drying apparatus 1F, air is circulated as follows. The air injected through nozzles 8 flows through interior space 3 toward the rearward end while picking up moisture from the opposite surfaces of photosensitive web S, thus increasing the humidity toward the housing intermediate. When the humid air passes by water vapor permeable membranes 18, some water vapor in the humid air penetrates through membranes 18 optionally along with some air to the exterior of housing 2. As a result of the outward penetration of water vapor through membranes 18, the air in interior space 3 gradually reduces its humidity toward the rearward end and relatively less humid air is discharged from exit 5. The less humid air is then sucked into upper and lower inlets 13 at negative pressures due to the actuation of fans 15. The air is fed forward through ducts 12 by the action of fans 15, heated by heaters 16, and then injected into housing 2 through nozzles 8 to form high velocity warm air streams in interior space 3 again.

In this embodiment, the end of drying Y is positioned somewhat downstream of the forward end or intermediate a first half section of water permeable membranes 18.

Instead of the illustrated arrangement, the water vapor permeable membranes 18 may be disposed intermediate ducts 12, for example, in zones A of ducts 12 in FIG. 6. Then, the end of drying Y is positioned adjacent exit 5 or duct inlet 13. This arrangement is more likely to achieve the specified humidity difference between the beginning of drying X and the end of drying Y since a rearwardly increasing gradient of humidity is established throughout housing 2.

In these drying apparatus 1E and 1F, the air may be dehumidified to different degrees between the upper and lower air streams on the upper and back surfaces of photosensitive web S. It is preferred to supply relatively less humid air as the upper air stream on the upper or emulsion surface of photosensitive web S.

There have been described six different drying apparatus 1A to 1F which can be classified into the following groups. First group:

The drying apparatus 1A and 1B belong to a cool air one-way supply type in which air at room temperature is supplied without heating or recycling. Second group:

The drying apparatus 1C and 1D belong to a warm air one-way supply type in which heated air is supplied without recycling. Third group:

The drying apparatus 1E and 1F belong to a warm air recycle type in which dehumidified, heated air is recycled.

The invention may be applicable to any drying apparatus other than the above-described types, for example, to dehumidified cool air one-way supply, dehumidified warm air one-way supply, cool air recycle, warm air recycle, dehumidified cool air recycle types and any combinations thereof.

FIG. 7 illustrates a further embodiment of the invention. The drying apparatus 1G illustrated is designed to carry out different modes of drying in early and later stages of drying. In the left section of FIG. 7 that corresponds to an early stage of drying, the drying apparatus 1G includes a pair of air circulating systems of symmetric structure outside the upper and lower walls of housing 2. Each air circulating system includes a duct 50 having at its rearward end an inlet 51 connected to an intermediate of housing 2. The air circulating system further includes a dehumidifier 19 in duct 50, and a fan 6 disposed at the forward end of duct 50. The fan 6 has a discharge outlet 7 which is connected to nozzle 8 which is, in turn, connected to the wall of housing 2 for communication with interior space 3. A heater 10 is disposed in discharge outlet 7 of fan 6. The dehumidifier 19 may be the same as the previously described dehumidifier 14 and a dehumidifier using an electronic cooling element as shown in FIG. 10 is advantageously used. The fan 6 and heater 10 may also be the same as in the previous embodiments.

At the intermediate of housing 2 downstream of duct inlets 51 are disposed a pair of transition conveyor rollers 32.

In the right section of FIG. 7 that corresponds to a later stage of drying, the drying apparatus 1G includes a pair of upper and lower nozzles 8 as used in the third embodiment. The nozzles 8 are connected at proximal ends to fans 6 through discharge outlets 7 and attached at distal ends to the upper and lower walls of housing 2. Heaters 10' are disposed in discharge outlets 7 of fans 6.

The drying apparatus 1G operates as follows. In the early stage of drying, air is circulated through housing interior space 3 and ducts 50 under the impetus of fans 6. More particularly, the air which has been used in drying is taken into ducts 50 through inlets 51, dehumidified by dehumidifiers 19 intermediate ducts 50, heated by heaters 10, preferably to a temperature of 70° C. or higher, and again introduced into interior space through nozzles 8. The beginning of drying Y is positioned near the joints between housing 2 and nozzles 8. Thus the photosensitive web S is dried with relatively high temperature, low humidity air (for example, temperature: 70° C. or higher, average humidity: about 1 to 20% RH) in the early drying stage.

In the later stage of drying, the air taken in from the exterior by the action of fans 6 is heated by heaters 10,, introduced into interior space 3 through nozzles 8, moved rearward through interior space 3, and discharged through exit 5.

Preferably, the temperature of the air heated by heaters 10' in the later stage is lower than that by heaters 10 in the early stage. The heaters 10' may be operated so as to produce a smaller amount of heat than the heaters 10. Alternatively, the heaters 10' may be turned off for supplying cool air. In either case, the photosensitive web S is dried with relatively low temperature, high or middle humidity air (for example, temperature: room temperature to 60° C., average humidity: about 40 to 90% RH) in the later drying stage.

The sequence of the early stage of high temperature/-low humidity air drying followed by the later stage of low temperature/high (or middle) humidity air drying is best suited for preventing defects like reticulation on the emulsion surface of photosensitive material.

In the drying apparatus of the present invention, the material for housing 2 is not particularly limited. If the apparatus is of the warm air supply type classified as the second and third groups, the housing material should be heat resistant, and preferably heat insulating. For example, the housing 2 may be formed from various ceramic materials such as alumina, zirconia, asbestos, and glass wool, and metals such as stainless steel, Hastelloy, copper and copper alloys. It is also contemplated to cover a metallic housing with heat insulating material such as asbestos, felt, foil aluminum, and glass wool. In particular, those portions of housing 2 of the drying apparatus 1D shown in FIG. 4 to which film heaters 11 are attached may preferably formed of heat conductive material such as copper and copper alloys.

In the drying apparatus of the invention, air is passed through interior space 3 of housing 2 at a high velocity. The preferred range of average flow velocity (linear velocity) of air is shown in Table 1 for each of the eight different embodiments. The last row of Table 1 corresponds to the average flow velocity of air through the duct of the prior art drying apparatus.

The average flow velocity of air reported in Table 1 is calculated according to the expression:

$$U = V/S$$

wherein

U is an average flow velocity of air,

V is a flow rate of air supplied, and

S is a transverse cross sectional area of interior space 3.

TABLE 1

| Drying apparatus | Average flow velocity of air (m/sec.) |
|---|---|
| 1A | 10-200 |
| 1B | 6-150 |
| 1C | 10-200 |
| 1D | 6-100 |
| 1E | 20-200 |
| 1F | 2-60 |
| 1G | 40-200 |
| 1H | 2-60 |
| Prior Art | 0.1-1 |

When it is desired for the drying apparatus 1A through 1H to carry out the pneumatic transfer, the average flow velocity shown in Table 1 is preferably increased 0 to about 20%.

Since the drying apparatus of the invention has a housing whose interior space has a slit-shaped cross section, the volume of the housing interior space is significantly smaller than that in the prior art drying apparatus. The reduced volume of the housing interior space allows air to be blown at such a high velocity as reported in Table 1.

Passage of the photosensitive web S through the high velocity air flow offers an increased amount of air contacting with the web surface per unit time, completing drying within a shorter time than in the prior art and allowing even the drying apparatus 1A or 1B of the cool air supply type to fully dry the photosensitive web S within an acceptable time.

Since only a small volume of air is necessary for drying, even the drying apparatus 1C to 1G which are adapted to heat the drying air require only a relatively reduced energy consumption for heating and a short heat-up time at the start of drying operation. Since the drying apparatus of the warm air one-way supply type such as 1C, 1D and 1G (later stage) discard small amounts of air and heat to the exterior, the apparatus has less influence like temperature rise on the environment of a room where the apparatus is installed.

Since the drying apparatus of the recycle type such as 1E, 1F and 1G (early stage) reuse the heat that the used drying air possesses, further savings of energy consumption are achieved and little discharge of air and heat to the exterior gives no influence on the room environment.

Provision of the dehumidifying means contributes to a significant improvement in drying efficiency. Particularly, the dehumidifying means combined with the heating means is effective in avoiding defects such as reticulation and luster loss on the emulsion surface of photosensitive material because drying with high temperature, low humidity air is effected at least in an early stage of drying.

Figure 8:
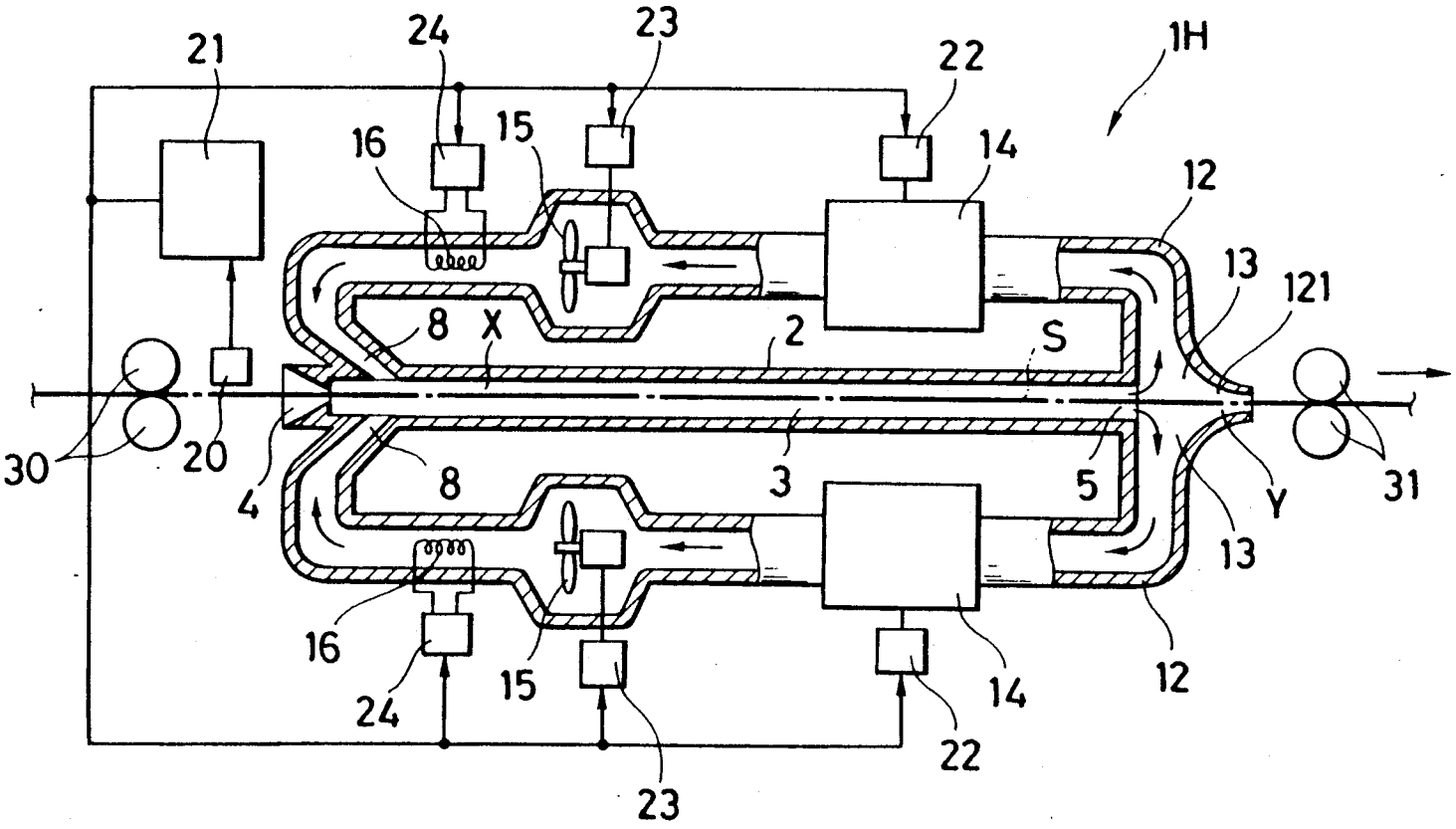

FIG. 8 illustrates a drying apparatus 1H according to an eighth embodiment of the invention. The drying apparatus 1H includes control means for controlledly actuate the drying apparatus in response to the supply or passage of photosensitive web S through housing 2.

The control means includes a sensor 20 disposed in a web transfer path between housing entrance 4 and delivery conveyor rollers 30 for detecting the presence or absence of photosensitive web S. The sensor 20 may be of any desired types including contact sensors and optical sensors. The sensor 20 is connected to a control unit 21 in the form of a microcomputer, for example. The control unit 21 has an output line electrically connected to power supplies 22 of dehumidifiers 14, power supplies 23 of fans 15, and power supplies 24 of heaters 16, which are respectively disposed outside the upper and lower walls of housing 2.

When the leading edge of photosensitive web S passes by a point in registry with sensor 20, the sensor 20 detects the delivery of photosensitive web S and transmits a detection signal to control unit 21 which converts the signal to a digital signal. Based on the input signal, the control unit 21 produces a command signal for turning on power supplies 22, 23, and 24. As a result, dehumidifiers 14, fans 15, and heaters 16 are actuated substantially at the same time to commence drying.

The control unit 21 has a timer built therein (not shown) which is adapted to produce a command signal for turning off power supplies 22, 23, and 24 when a predetermined duration of time (referred to as operating time) has passed since the turning-on of the power supplies. The operating time should be at least equal to or somewhat longer than the time taken until the drying of photosensitive web S is completed, that is, until the trailing edge of photosensitive web S passes by exit 5. The operating time may be determined to be the longest one among possible operating times calculated by taking into account the length of photosensitive web S, transfer speed and other time-governing parameters. Alternatively, the operating time may be determined through manual manipulation or automatically in accordance with the operating parameters. In the latter case, a table of operating times relative to operating parameters may be stored in control unit 21 which can select an optimum value therefrom.

The determination of the time to turn off power supplies 22, 23, and 24 is not limited to the above. mentioned timer. For example, a downstream sensor similar to upstream sensor 20 may be disposed at housing exit 5 for detecting that photosensitive web S has left housing 2. Upon receipt of a signal indicative of the complete passage of photosensitive web S, the control unit 21 produces a command signal for turning off power supplies 22, 23, and 24.

In the practice of the invention, the organization of the control means is not limited to the one for detecting the passage of photosensitive web S. For example, the rotation of conveyor rollers 30 and 31 may be mechanically or electrically detected. Upon receipt of signals concerning the roller rotation, the control unit 21 produces command signals for turning on and off power supplies 22, 23, and 24.

The actuation and interruption of the drying apparatus is not limited to the automatic control described above. A manual operation is also contemplated whereby power supplies 22–24 are turned on upon commencement of drying of a photosensitive web and turned off upon completion of the drying.

All the power supplies 22–24 are turned on and off at the same time in the above-described embodiments although they may be turned on and off with a time lag. For example, dehumidifiers 14 and heaters 16 may be first turned off and fans 15 be turned off after a lapse of a preset time, with an advantage of preventing local heat or moisture stagnation in ducts 12. Alternatively, only dehumidifiers 14 and heaters 16 are turned on and off as in the previous embodiments while fans 15 continue to operate.

The drying apparatus 1H with such control means operates only when it is desired to dry photosensitive web S, minimizing energy consumption and eliminating any influence on the room environment.

Such control is possible only with the construction of the invention. Since the prior art drying apparatus uses a duct of an increased volume through which photosensitive material passes for drying, the apparatus has to heat a correspondingly large volume of air and thus requires an increased heat-up time. Therefore, it is almost impossible to controlledly actuate the drying apparatus only when a new piece of photosensitive material is dried.

In contrast, with the drying apparatus of the invention, even cool air drying is made practical. In this case, no attention need be paid to the heat-up time. In the case of warm air drying with the drying apparatus of the invention, only a small amount of air must be heated so that the heat-up time is minimized. Therefore, it becomes possible to controlledly actuate the drying apparatus only when a new piece of photosensitive material is dried.

The type of photosensitive material which can be dried in the apparatus of the present invention is not particularly limited. Any desired types of photosensitive material may be dried, including color negative films, color reversal films, color photographic paper, color positive films, color reversal photographic paper, printing photographic photosensitive material, radiographic photosensitive material, black-and-white negative films, black-and-white photographic paper, and micro-film photosensitive material.

The drying apparatus of the present invention may be used as such or in combination with a variety of photosensitive material processing apparatus such as automatic developing machines, wet color copying machines (APC), video printer processors, and proof color paper processors.

Although several embodiments of the invention have been described to illustrate the construction of the drying apparatus, the invention is not limited thereto. For example, any desired portions of the drying apparatus 1A to 1H may be tailored so as to construct a drying apparatus for a particular purpose. Variations and modifications may be made to any portions of the drying apparatus.

All the drying apparatus 1A to 1H have independent air supply systems (each including a fan, duct, heater, and dehumidifier) associated with the upper and lower walls of the housing and corresponding to the upper and lower air flowpaths on the upper and back surfaces $S_A$ and $S_B$ of photosensitive web S. It is possible to provide a single air supply system from which the drying air is diverted to upper and lower nozzles 8 connected to the upper and lower walls of housing 2.

EXAMPLES

Examples of the present invention are given below by way of illustration and not by way of illustration.

EXAMPLE 1

A drying apparatus of a structure as shown in FIG. 2 was manufactured, with which a web of wet processed photosensitive material was dried. The dimensions of components of the apparatus are shown below together with its operating conditions for drying.

Housing:
Entire length: 1200 mm
Interior space transverse width: 100 mm
Interior space height T: 4 mm
Material: stainless steel
Nozzle:
Arrangement: 3 pairs, upper/lower symmetric
Inclination angle $\alpha$: 30° (same for all nozzles)
Blowing opening transverse width Wn: 80 mm (same for all nozzles)
Total of blowing opening longitudinal distances: 3 mm (1 mm×3)
Drying air:
Temperature: room temperature (-24° C.)
Humidity: normal humidity (-55% RH)
Flow velocity through housing: 12 m/sec.
Photosensitive material:
Type: color paper type 03 manufactured by Fuji Photo Film Co., Ltd.
Dimensions: 89 mm wide×20 mm long×220 μm thick
Transfer speed: 1.0 m/min

EXAMPLE 2

A drying apparatus of a structure as shown in FIG. 3 was manufactured, with which a web of wet processed photosensitive material was dried. The dimensions of components of the apparatus are shown below together with its operating conditions for drying.

Housing:
Entire length: 500 mm
Interior space transverse width: 220 mm
Interior space height T: 3 mm
Material: asbestos
Nozzle:
Arrangement: 1 pair, upper/lower symmetric
Inclination angle $\alpha$: 45°
Blowing opening transverse width Wn: 190 mm
Blowing opening longitudinal distances: 1 mm
Drying air:
Temperature 80° C.
Humidity: normal humidity (~55% RH at 24° C.)
Flow velocity through housing: 23 m/sec.
Photosensitive material:
Type: color paper type 03 by Fuji Photo Film Co., Ltd.
Dimensions: 203 mm wide×20 mm long×220 μm thick
Transfer speed: 0.5 m/min.

EXAMPLE 3

A drying apparatus of a structure as shown in FIG. 7 was manufactured, with which a web of wet processed photosensitive material was dried. The dimensions of components of the apparatus are shown below together with its operating conditions for drying.

Housing:
Entire length: 600 mm
Interior space transverse width: 43 mm
Interior space height T: 5 mm
Material: stainless steel
Nozzle:
Arrangement: 2 pairs, upper/lower symmetric
Inclination angle $\alpha$: 30° (same for all nozzles)
Blowing opening transverse width Wn: 25 mm (same for all nozzles)
Total of blowing opening longitudinal distances: 2 mm (1 mm×2)
Dehumidifier:
Structure: as shown in FIG. 10
Peltier element: NSELECOOL® Model TECF-40 manufactured by Nippon Steel Corp. 40 W (34 kcal/hour), DC 4 ampere/24 volt, dehumidifying capacity: 1.1 liter/10 hours
Drying air for first stage:
Temperature: 70° C.
Humidity: up to 2% RH at 70° C.
Flow velocity through housing: 20 m/sec.
Drying air for second stage:
Temperature: 45° C.
Humidity: 60% RH at room temperature, 32% RH at 45° C.
Flow velocity through housing: 13 m/sec.
Photosensitive material:
Type: color paper type 03 by Fuji Photo Film Co., Ltd.
Dimensions: 35 mm wide×20 mm long×220 μm thick
Transfer speed: 0.5 m/min.

COMPARATIVE EXAMPLE 1

A web of wet processed photosensitive material was dried with a drying apparatus having the same structure under the same operating conditions as in Example 1 except the following parameters.

Housing entire length: 300 mm
Housing interior space height T: 40 mm
Nozzle blowing opening longitudinal distance total: 30 mm
Air flow velocity: 1.2 m/sec.
Photosensitive material transfer speed: 0.25 m/min.

COMPARATIVE EXAMPLE 2

A web of wet processed photosensitive material was dried with a drying apparatus having the same structure under the same operating conditions as in Example 2 except the following parameters.

Housing entire length: 200 mm
Housing interior space height T: 60 mm
Nozzle blowing opening longitudinal distance: 10 mm
Air temperature: 60° C.
Air flow velocity: 1.1 m/sec.
Photosensitive material transfer speed: 0.2 m/min.

With each of the drying apparatus of Examples 1-3 and Comparative Examples 1-2, photosensitive webs were continuously dried to a total length of 40 meters while the relative humidity (%RH) of drying air was measured both at the beginning of drying X and the end of drying Y. For the measurement of relative humidity, a precision digital thermometer/hygrometer (body TRH-10A, sensor THP-12) was used. The results are shown in Table 1.

The emulsion surface of the dried photosensitive web was observed through a magnifying glass at ten spots along each line spaced 1 m, 3 m, and 10 m from the trailing edge of the web, examining the occurrence of reticulation.

TABLE 1

| Example No. | Lh/Ln | Dehumidifier | % RH X | % RH Y | ΔRH | Reticulation |
|---|---|---|---|---|---|---|
| E1 | 1200/3 = 400 | no | 55 | 91 | 36 | Little |
| E2 | 500/1 = 500 | no | 17 | 90 | 73 | Little |
| E3 | 600/2 = 300 | yes | 3 | 85 | 82 | No |
| CE1 | 300/30 = 10 | no | 35 | 60 | 25 | Severe |
| CE2 | 200/10 = 20 | no | 43 | 70 | 27 | Some to severe |

In Table 1, Lh/Ln is a ratio of housing entire length to (total) nozzle blowing opening longitudinal distance, and ΔRH is the difference between the relative humidity (%RH) at the end of drying Y and that at the beginning of drying X.

In Examples 1-3, the difference (ΔRH) in relative humidity between the end of drying Y and the beginning of drying X is more than 30% RH. On the contrary, ΔRH is less than 30% RH in Comparative Examples 1 and 2 partly because the ratio of housing entire length to (total) nozzle blowing opening longitudinal distance is low and partly because of the absence of a dehumidifier.

No significant reticulation was observed in Examples 1 and 2, and no reticulation was observed at all in Example 3 where the drying apparatus had a dehumidifier incorporated. Reticulation occurred in Comparative Examples 1 and 2. In particularly, severe reticulation occurred in Comparative Example 1 probably because of the small ΔRH.

There has been described a drying apparatus wherein a rectangular housing defines an interior space through which a photosensitive material travels in a longitudinal direction in parallel flow with drying air, the space having a slit-shaped transverse cross section in which the height dimension is substantially smaller than the transverse dimension. The slit-shaped cross section of the air flowpath is effective for efficient drying, particularly in reducing the drying time.

The housing having a slit-shaped cross section has a reduced volume so that the amount of drying air may be reduced. Energy consumption savings are expected because the amount of heat applied to drying air can be reduced and the drying apparatus can be controlledly actuated only for a necessary operating period.

The reduction in height and hence, volume of the housing and the reduction in amount of air needed allow the use of fans and heaters of reduced size. Thus the drying apparatus as a whole can be reduced in size.

By properly controlling the humidity and temperature of drying air, the photosensitive material after drying can present a coating of quality, particularly a satisfactory emulsion surface free of reticulation.

Although some preferred embodiments have been described, many modifications and variations may be made thereto in the light of the above teachings. It is therefore to be understood that within the scope of the appended claims, the invention may be practiced otherwise than as specifically described.

I claim:

1. An apparatus for drying a silver halide color photosensitive material in the form of a web, comprising a housing defining an interior space having longitudinal, transverse and height dimensions, said interior space having a slit-shaped transverse cross section in which the height dimension is substantially smaller than the transverse dimension, and fan means connected to said housing for blowing drying gas into the interior space to dry the photosensitive web while the photosensitive web is being transferred through the interior space in a longitudinal direction, wherein said housing is a generally elongated box-shaped housing having upper and lower walls, said housing has entrance and exit openings at longitudinally opposed ends wherein the photosensitive web enters said housing through the entrance opening and leaves said housing through the exit opening, said fan means includes at least one pair of nozzles attached to the upper and lower walls of said housing, said one pair of nozzles being adjacent to the entrance opening for introducing the drying gas into the interior space, whereby the drying gas passes through the interior space in parallel flow with the photosensitive web, a ratio of $L/L_N$ of housing entire length L to total nozzle blowing opening longitudinal distance $L_N$ is at least 30, and the difference in relative humidity between the drying gases in said interior space at the beginning and the end of drying is controlled to at least 30% RH.

2. The drying apparatus of claim 1 wherein said housing is a generally elongated box-shaped housing having upper and lower walls and the cross section of the housing interior space is generally rectangular.

3. The drying apparatus of claim 2 wherein said housing has entrance and exit openings at longitudinally opposed ends wherein the photosensitive web enters said housing through the entrance opening and leaves said housing through the exit opening.

4. The drying apparatus of claim 3 wherein said fan means is connected to said housing adjacent the entrance opening whereby the drying gas passes through the interior space in parallel flow with the photosensitive web.

5. The drying apparatus of claim 4 wherein said fan means includes a pair of nozzles attached to the upper and lower walls of said housing adjacent the entrance opening for introducing the drying gas into the interior space.

6. The drying apparatus of claim 1 wherein said fan means includes a pair of fans connected to said pair of nozzles, respectively.

7. The drying apparatus of any one of claims 1 and 6 which further comprises heater means for heating the drying gas.

8. The drying apparatus of claim 7 wherein said heater means is associated with said fan means for heating the drying gas before it is introduced into the housing interior space.

9. The drying apparatus of claim 7 wherein said heater means is disposed on said housing adjacent the junction between said fan means and said housing for heating the drying gas immediately after it is introduced into the housing interior space.

10. The drying apparatus of claim 4 wherein said fan means includes longitudinally spaced pairs of nozzles attached to the upper and lower walls of said housing for introducing the drying gas into the interior space, a first pair of nozzles being attached to the upper and lower walls of said housing adjacent the entrance opening.

11. The drying apparatus of any one of claims 1 and 6 which further comprises means for dehumidifying the drying gas.

12. An apparatus for drying a photosensitive material in the form of a web, comprising a housing defining an interior space having longitudinal, transverse and height dimensions, said interior space having a slit-shaped transverse cross section in which the height dimension is substantially smaller than the transverse dimension, fan means connected to said housing for blowing drying gas into the interior space to dry the photosensitive web while the photosensitive web is being transferred through the interior space in a longitudinal direction, means for dehumidifying the drying gas, and duct means connected to longitudinal opposed end portions of said housing for feeding the drying gas which has passed through the interior space back to near the entrance of the interior space through said duct means, wherein said dehumidifying means and said fan means are arranged in said duct means.

13. The drying apparatus of claim 12 which further comprises heater means arranged in said duct means for heating the drying gas before it is fed back to the housing interior space.

14. The drying apparatus of claim 1 which further comprises control means for detecting the differences in relative humidity between locations proximate to said entrance and exit openings for controlledly actuating the fan means.

15. An apparatus for drying a photosensitive material in the form of a web, comprising a housing defining an interior space having longitudinal, transverse and height dimensions, said interior space having a slit-shaped transverse cross section in which the height dimension is substantially smaller than the transverse dimension and wherein said housing cross section is changed in the height dimension along said longitudinal dimension, fan means connected to said housing for blowing drying gas into the interior space to dry the photosensitive web while the photosensitive web is being transferred through the interior space in a longitudinal direction, wherein the difference in relative humidity between the drying gases in said interior space at the beginning and the end of drying is controlled to at least 30% RH.

16. An apparatus for drying a photosensitive material in the form of a web, comprising a housing defining an interior space having longitudinal, transverse and height dimensions, said interior space having a slit-shaped transverse cross section in which the height dimension is substantially smaller than the transverse dimension, and fan means connected to said housing for blowing drying gas into the interior space to dry the photosensitive web while the photosensitive web is being transferred through the interior space in a longitudinal direction, and wherein said housing has entrance and exit openings at longitudinally opposed ends wherein the photosensitive web enters said housing through the entrance opening and leaves said housing through the exit opening, said entrance opening comprising ramp means for guiding said web and means for preventing reverse flow of gas.

17. An apparatus for drying a photosensitive material in the form of a web, comprising a housing defining an interior space having longitudinal, transverse and height dimensions, said interior space having a slit-shaped transverse cross section in which the height dimension is substantially smaller than the transverse dimension, said housing being generally elongated box-shaped housing having upper and lower walls and the cross section of said housing interior space being generally rectangular and fan means connected to said housing for blowing drying gas into the interior space to dry the photosensitive web while the photosensitive web is being transferred through the interior space in a longitudinal direction, said fan means comprising nozzle means attached to said upper and lower walls of said housing for introducing the drying gas into the interior space, said nozzles having a width in the transverse direction that is less than the width of said web to provide transverse air flow for stabilizing said web.

18. The drying apparatus of claim 1 wherein the housing entire length is from 100 to 1,000 mm.

19. The drying apparatus of claim 1 wherein the height T of said space is 3 to 1000 times the thickness of said photosensitive web.

20. The drying apparatus of claim 1 wherein the flow velocity of air is 2 to 200 m/sec.

* * * * *

UNITED STATES PATENT AND TRADEMARK OFFICE

CERTIFICATE OF CORRECTION

PATENT NO. : 5,022,167

DATED : June 11, 1991

INVENTOR(S) : Takashi Nakamura

It is certified that error appears in the above-identified patent and that said Letters Patent is hereby corrected as shown below:

Title page, "20 Claims, 7 Drawing Sheets" should read --16 Claims, 7 Drawing Sheets--.

Signed and Sealed this

Eighth Day of December, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,022,167

DATED : June 11, 1991

INVENTOR(S) : Takashi Nakmura

It is certified that error appears in the above-identified patent and that said Letters Patent is hereby corrected as shown below:

Title page, "20 Claims, 7 Drawing Sheets" should read --16 Claims, 7 Drawing Sheets--. (as shown on attached page)

In column 18, lines 25-43, please delete Claims 2, 3, 4 and 5.

This certificate supersedes Certificate of Correction issued December 8, 1992.

Signed and Sealed this

Thirtieth Day of March, 1993

*Attest:*

STEPHEN G. KUNIN

*Attesting Officer*

*Acting Commissioner of Patents and Trademarks*

United States Patent [19]

Nakamura

[11] Patent Number: 5,022,167

[45] Date of Patent: Jun. 11, 1991

[54] PHOTOSENSITIVE MATERIAL DRYING APPARATUS

[75] Inventor: Takashi Nakamura, Minami-ashigara, Japan

[73] Assignee: Fuji Photo Film Co., Ltd., Kanagawa, Japan

[21] Appl. No.: 402,367

[22] Filed: Sep. 5, 1989

[30] Foreign Application Priority Data

Sep. 5, 1988 [JP] Japan ..... 63-221796
Nov. 14, 1988 [JP] Japan ..... 63-287445
Jun. 16, 1989 [JP] Japan ..... 1-153653

[51] Int. Cl.[5] ..... F26B 13/00
[52] U.S. Cl. ..... 34/160; 34/156
[58] Field of Search ..... 34/155, 10, 156, 160

[56] References Cited

U.S. PATENT DOCUMENTS 3,293,775 12/1966 Kitrosser ..... 34/156
4,017,982 4/1977 Goffredo ..... 34/23
4,053,990 10/1977 Bielinski ..... 34/23
4,142,301 3/1979 Goodall ..... 34/155
4,245,397 1/1981 Laar et al. ..... 34/155

*Primary Examiner*—Henry A. Bennet
*Attorney, Agent, or Firm*—Sughrue, Mion, Zinn, Macpeak & Seas

[57] ABSTRACT

An apparatus for drying a photosensitive material in the form of a web is provided wherein a slender box-shaped housing defines an interior space having a rectangular slit-shaped transverse cross section in which its thickness dimension is substantially smaller than its transverse dimension. A fan is connected to the housing through a nozzle for blowing drying air into the interior space to dry the photosensitive web while the web is transferred through the interior space in a longitudinal direction. The difference in relative humidity between upstream and downstream air flows in the interior space at the beginning and the end of drying is controlled to at least 30% RH.

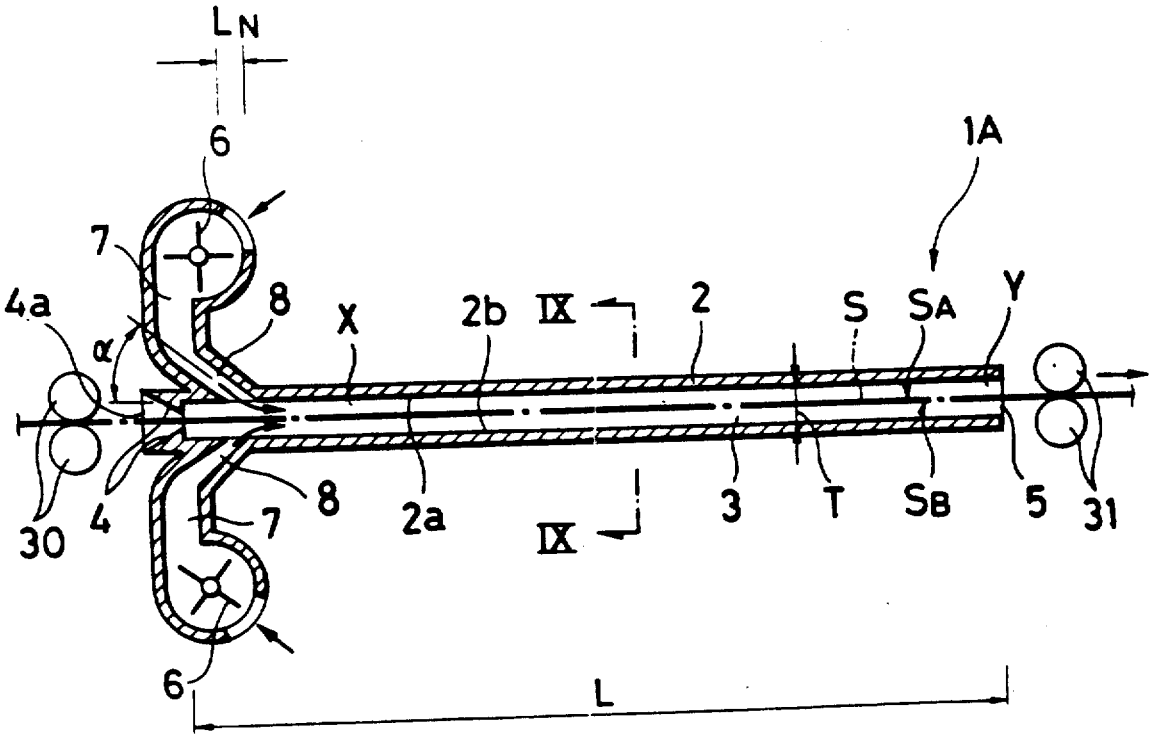

16 Claims, 7 Drawing Sheets